United States Patent [19]

VanDarwarka

[11] 4,316,575

[45] Feb. 23, 1982

[54] MAILBOX INDICATOR

[76] Inventor: Juel L. VanDarwarka, 2120 W. 23rd, Eugene, Oreg. 97405

[21] Appl. No.: 158,323

[22] Filed: Jun. 10, 1980

[51] Int. Cl.[3] ..... A47G 29/12

[52] U.S. Cl. ..... 232/35; 232/34

[58] Field of Search ..... 232/35, 34

[56] References Cited

U.S. PATENT DOCUMENTS

| | | | |
|---|---|---|---|
| 2,802,622 | 8/1957 | Steffner | 232/35 |
| 3,343,784 | 9/1967 | Waldhaus | 232/35 |
| 3,482,543 | 12/1969 | Guidos | 232/35 |
| 3,523,639 | 8/1970 | Wiebe | 232/35 |
| 4,072,265 | 2/1978 | Jones | 232/35 |

*Primary Examiner*—Francis K. Zugel

*Attorney, Agent, or Firm*—James D. Givnan, Jr.

[57] ABSTRACT

An indicator for attachment to a mailbox for actuation upon mailbox door opening. A flag asembly is mounted on an elevated base of the indicator and includes a flag spring urged to the raised position. The flag is hingedly attached to a rotatable carrier plate permitting optimum flag visibility to the home owner. A flag release assembly includes an arm having one end in the mailbox door path with flag release occurring upon lifting of the arm which disengages the flag from a magnetic latch. The base and carrier plate have concentric openings through which flag release member extends to permit carrier plate rotation during flag positioning.

6 Claims, 4 Drawing Figures

MAILBOX INDICATOR

BACKGROUND OF THE INVENTION

The present invention relates generally to indicators for placement on rural type mailboxes and particularly to such indicators actuated by mailbox door opening.

Considerable prior art exists relating to mailbox mounted indicators primarily directed toward providing an indication to the box owner that the box has been visited by the postman to preclude an unnecessary trip to inspect the box. Generally speaking, such indicators require at least some degree of mailbox alteration which is undesirable such as, for example, the drilling of holes in the box which renders same other than watertight and, in some instances, the alteration effort is beyond the typical box owner's mechanical ability to preclude attachment by the box owner. Further drawbacks to the known art include the complexity of the indicators and hence a high manufacturing cost; the indicator being non-adjustable to render viewing of same difficult from a location other than directly rearward of the box; certain indicators being inoperable in adverse weather and susceptible to damage by door opening movement if operation is hindered by ice and snow. Other indicator shortcomings include requiring additional effort by the postman, interference with access to the box interior, require mounting on the side of the box which is not possible in a row of closely spaced boxes. Still other indicators utilize couplings or latches susceptible to wear, bending and vandalism resulting in indicators of limited reliability.

In the known prior art U.S. Pat. Nos. 3,095,140; 3,523,639 and 3,102,684 are believed the most pertinent for the reason that mailbox indicators are disclosed for attachment adjacent the mailbox door which upon opening unlatches a spring urged flag. Such indicators do not overcome the aforementioned shortcomings nor do they provide a flag positionable for optimum viewing from a residence. Further, no magnetic latch is disclosed. U.S. Pat. Nos. 740,237; 720,279 and 792,133 disclose various types of mailboxes each having a manually rotatable flag arrangement entirely dissimilar to applicant's positionable flag assembly.

SUMMARY OF THE PRESENT INVENTION

The present invention is embodied within a mailbox mounted indicator actuated by the mailbox door and capable of providing a signal to the box owner throughout a wide range of viewing angles.

A disclosure Document No. 80,613 concerning the present invention was filed in the U.S. Patent and Trademark Office on May 7, 1979.

The indicator includes a base for securement to the upper forward portion of the box so as to locate a trigger arm in close proximity to the box door. Said arm, when actuated by the mailbox door, lifts flag release means which lifts the flag component away from its latch. The flag is mounted on carrier plate and is spring biased causing flag elevation upon being lifted out of latch engagement. The carrier plate is rotatable about the release means to enable the box owner to locate the flag for optimum viewing from his or her residence. The trigger arm is vertically adjustable after installation of the indicator on the box to permit the box owner to adjust arm travel to a minimum range for flag release with only very slight arm movement being required. Accordingly, should normal indicator operation be prevented by an accumulation of ice or snow, the mailbox door may be opened and closed in the normal manner without damage to the indicator.

Important objectives of the present invention include the provision of a mailbox indicator capable of providing a signal to the box owner regardless of the angularity of box location from the home by reason of a rotatably mounted flag component being positionable in an optimum manner, i.e., transversely to the line of sight; the provision of a mailbox indicator having a flag assembly rotatable about the axis of release means to permit rotational mounting of the flag at least throughout a range of 180 degrees; the provision of a mailbox indicator utilizing a magnetic latch to preclude wear and misalignment of conventional latching arrangements; the provision of a mailbox indicator including a trigger arm vertically adjustable to determine the desired degree of operative displacement by the mailbox door with only limited displacement effecting release while avoiding indicator damage in the event of snow or ice preventing normal operation of the indicator; the provision of a mailbox indicator of extremely low manufacturing cost yet one having a high degree of reliability; the provision of a mailbox indicator suited for permanent adhesive securement to a mailbox.

DETAILED DESCRIPTION OF THE PREFERRED EMBODIMENT

Figure 1:
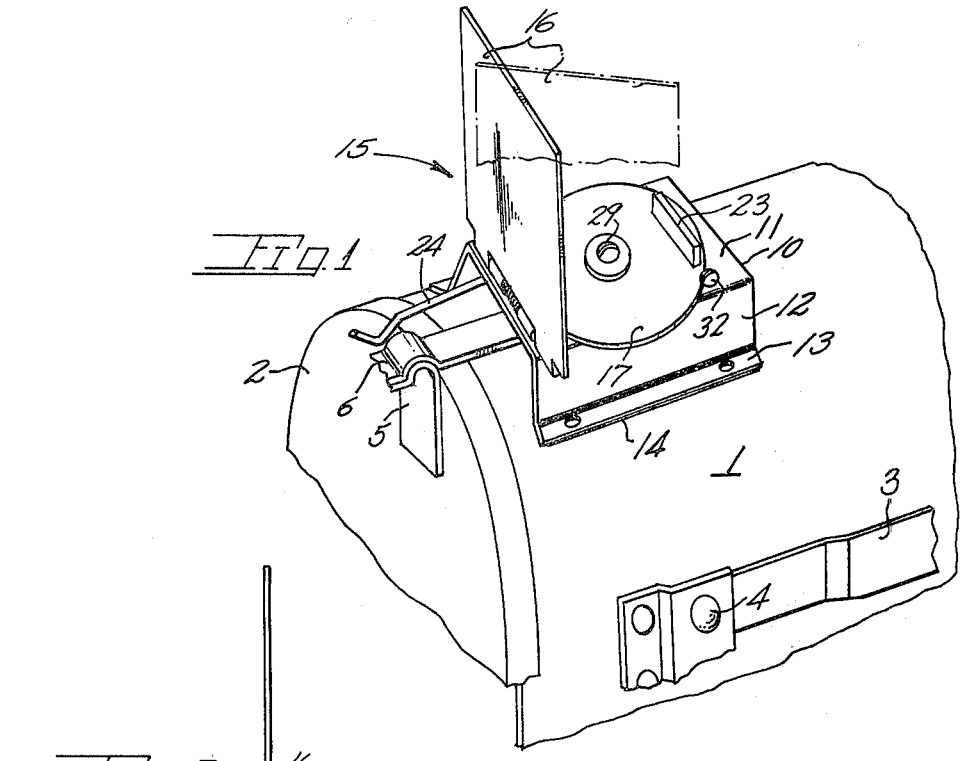
FIG. 1 is a fragmentary perspective view of a conventional rural mailbox with the present indicator in place thereon.

With continuing attention to the drawing, the reference numeral 1 thereon indicates a conventional, rural type mailbox which is typically mounted singly or in a row in an elevated manner for convenient access and which includes a door 2, a flag 3 pivoted at 4 which is used by the box owner to indicate the presence of pick-up mail within the box. Door 2 includes a latch member 5 which yieldably engages a second latch member 6 mounted on the apex of box 1. Latch component 5 includes a depending lip portion constituting a finger pull. The foregoing structure is standard on a typical rural mailbox. None of such structure is interfered with by use of the present indicator. The present indicator may be advantageously used with other types of mailboxes or with other structures to indicate movement of a structure component.

With attention now to the present indicator, the same includes a base 10 which is of generally U-shaped configuration having a top wall 11, side walls 12, and outwardly directed flanges 13. Said flanges may be apertured to receive fasteners, but preferably are provided with underlying strips of pressure sensitive material 14 adhesively coated on both surfaces to enable base securement to mailbox 1 simply by urging the strips into pressured contact with the mailbox surface. Suitable adhesive strips are manufactured and sold by the 3M Company.

Figure 4:
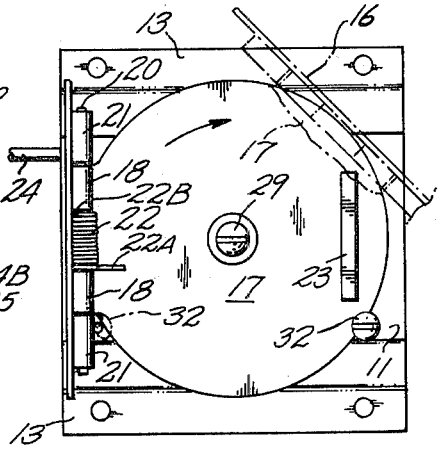
FIG. 4 is a top plan view of FIG. 2.

A flag assembly of the indicator is indicated generally at 15 and includes a metallic flag 16 swingably mounted on a circular carrier plate 17 the latter being rotatably adjustable on base 10. As best viewed in FIG. 4, the carrier has a pair of bosses 18 formed thereon to receive a pivot pin 20 on which is journalled the indicator flag having a pair of pin receiving collars 21 thereon to permit the indicator flag to rotate through 90 degrees about the pin axis. Interposed between bosses 18 is a helical spring 22 on the pivot pin with springs ends 22A and 22B bearing on the carrier and the indicator flag to bias the latter toward a raised position.

Figure 2:
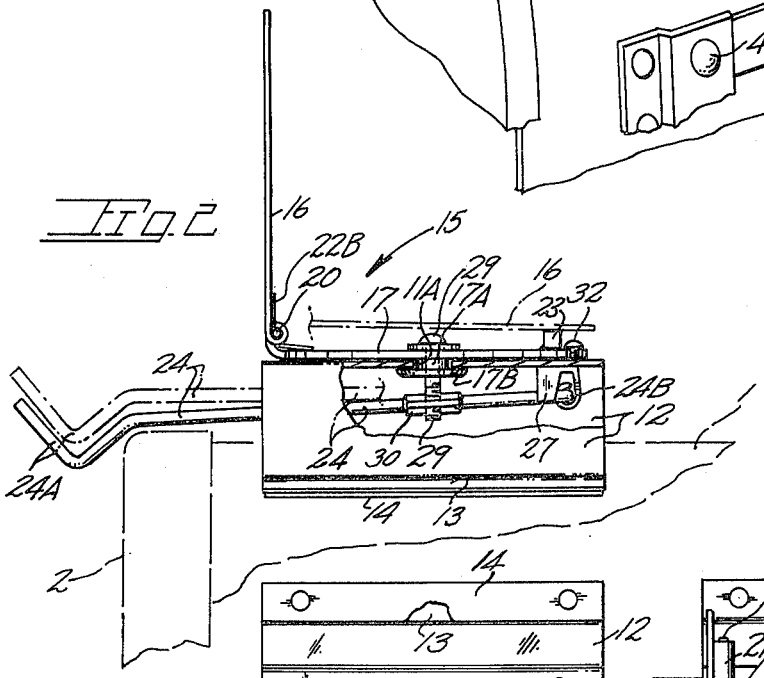
FIG. 2 is a side elevational view of the indicator shown full scale on top of a mailbox shown in phantom lines.
Figure 3:
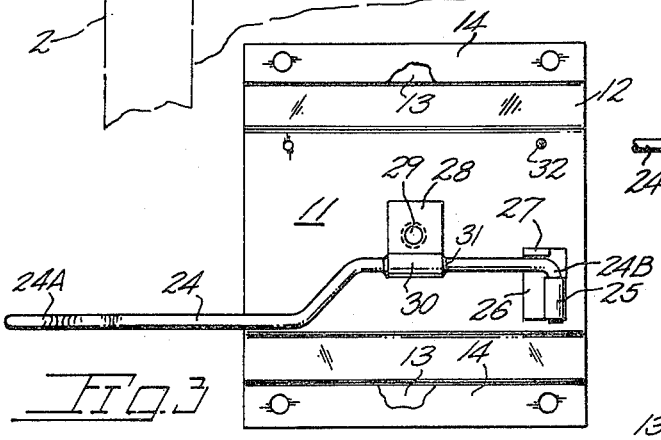
FIG. 3 is a bottom plan view of FIG. 2.

Suitably secured to the carrier is a permanent bar magnet 23 for latching engagement with the flag per the broken line lowered position of FIG. 2. The carrier is rotatably mounted to the apertured upper wall 11 of the base by pivot means shown as a downwardly displaced collar portion 17A which extends through base wall opening 11A with carrier securement being conveniently effected by collar peening at 17B. Obviously, other arrangements may be utilized to rotatably mount carrier plate 17 to the base. The downwardly extending collar portion 17A defines a central opening for reception of later described flag release means.

A flag release assembly includes a trigger arm 24 which extends forwardly from base 10 terminating in an irregular segment 24A which at least partially lies in the path of mailbox door 2 whereby the arm is displaced during door opening. The remaining or rearward end of arm 24 is bent perpendicular at 24B for reception within sleeve 25 formed as part of an attachment 26 to the underside of wall 11. A depending ear 27 confines arm 24 from sleeve disengaging motion. Affixed to the arm is a plate 28 which receives and supports flag release means 29 shown as a threaded member in threaded vertically adjustable engagement with arm mounted plate 28. A rolled portion 30 of the plate is conveniently secured to the arm by soldering at 31. Accordingly, vertical displacement of arm 24 causes arm motion about its pivotally mounted rearward end to raise release means 29 into upward contact with the underside of lowered flag 16 to displace same to the extent release from magnetic latch 23 is effected to permit flag elevation by spring 22. Carrier 17 is rotatably mounted, as earlier mentioned, on base 10 and may be rotated at least through 360 degrees in either direction from the centered FIG. 1 position for purposes of locating flag 16 normal to the line of sight (which may be angular to the mailbox centerline) from the box owner's residence to render the flag highly visible. It will be appreciated that in rural areas mailboxes are ofttimes a considerable distance from the residence which is usually not directly rearward of the mailbox. A set screw 32 locks carrier 17 in place after positioning to best suit the home owner's situation.

The utilization of a threaded fastener at 29 for release means enables vertical positioning of arm 24 to provide desired minimum arm travel upon door 2 moving therepast as shown in the broken line position of FIG. 2. Ideally, arm 24 is adjusted to cause effective vertical displacement of release means 29 with a minimum degree of arm travel. When so adjusted, should indicator flag 16 be prevented from moving by collected ice or snow, door 2 may still open and close in the normal manner by reason of arm 24 flexing up and down without damage to the remainder of the indicator. Clockwise rotation of release means 29, shown as a machine screw, may lift the arm 24 entirely out of the door path, if desired, to entirely deactivate the indicator.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. An indicator for mailbox attachment comprising,
- a base for securement to a door closed mailbox, said base including a wall spaced from the mailbox,
- a flag assembly on said base including a carrier plate, a spring biased flag hingedly mounted on said plate, pivot means mounting said carrier plate on said base wall, latch means operable to retain the flag in a retracted position, and,
- a flag release assembly including an arm swingably mounted at one of its ends to said base and terminating at its distal end in the path of the mailbox door, flag release means carried by said arm and engageable with said flag upon door opening to disengage same from said latch means.

2. The mailbox indicator claimed in claim 1 additionally including adhesive means applied to the underside of said base for the purpose of mailbox attachment.

3. The indicator claimed in claim 1 additionally including pivot means mounting said carrier plate on said base wall for rotation of the plate about an upright axis coincident with the axis of said flag release means.

4. The indicator claimed in claim 3 additionally including a lock screw acting on and securing the carrier plate against rotation.

5. The indicator claimed in claim 3 or 4 wherein said latching means is a permanent magnet secured to said carrier plate.

6. The indicator claimed in claim 5 whereby said flag release means is a threaded member enabling varying of the effective length thereof between said flag and said arm enabling flag release with different magnitudes of arm travel.

* * * * *